United States Patent [19]

Hanyu et al.

[11] Patent Number: 4,643,120

[45] Date of Patent: Feb. 17, 1987

[54] ZIGZAG SEWING MACHINE

[75] Inventors: Susumu Hanyu; Akio Koide, both of Tokyo, Japan

[73] Assignee: Janome Sewing Machine Industry Co., Ltd., Japan

[21] Appl. No.: 788,304

[22] Filed: Oct. 17, 1985

[30] Foreign Application Priority Data

Oct. 18, 1984 [JP] Japan ..... 59-156472

[51] Int. Cl.[4] ..... D05B 3/02; D05B 3/06

[52] U.S. Cl. ..... 112/466

[58] Field of Search ..... 112/466, 464, 465

[56] References Cited

U.S. PATENT DOCUMENTS 2,517,079 8/1950 Birdsall ..... 112/466 X 3,792,673 2/1974 Bianchi ..... 112/466 X 4,077,341 3/1978 Kasuga ..... 112/466 X 4,301,754 11/1981 Suzaki et al. ..... 112/465

4,428,311 1/1984 Sano ..... 112/466

*Primary Examiner*—Werner H. Schroeder

*Assistant Examiner*—Andrew M. Falik

*Attorney, Agent, or Firm*—William A. Drucker

[57] ABSTRACT

In a zigzag sewing machine a first group of pattern cams is rotated with a predetermined speed relative to a second pattern cam group by the arrangement of a transmission means between the first and second groups. A biasing means normally biases a cam follower to engage a selected pattern cam in said first and second groups. Cam selecting means operate to disengage the cam follower by way of the bias means and slidingly move the follower to a selected position along the cam groups.

2 Claims, 9 Drawing Figures

ZIGZAG SEWING MACHINE

BACKGROUND OF THE INVENTION

The invention relates to zigzag sewing machines in general and more particularly relates to a pattern cam driving mechanism of the zigzag sewing machine, in which a first group of pattern cams is rotated in association with the rotation of a drive shaft of the sewing machine with a reduced speed and a second group of pattern cams is rotated in association with the rotation of the first group of pattern cams with a further reduced speed with a transmission mechanism having a predetermined speed reduction ratio and provided between the first and second groups of pattern cams.

Generally a sewing machine has a standardized size and accordingly the space within the machine housing is limited. Especially in a zigzag sewing machine of the type having a number of pattern cams incorporated or separately provided as being exchangeable, in any case, to cooperate with a cam follower which is swingable in accordance with the contours of the pattern cams, the diameter of the pattern cams has been accordingly limited resulting in the limitation in the number of stitches produced in one rotation cycle of the pattern cams and therefore the variation of stitched patterns has been limited.

SUMMARY OF THE INVENTION

Accordingly it is an object of the invention to provide a zigzag sewing machine which is able to produce a number of varied stitch patterns. It is another object of the invention to provide a predetermined number of pattern cams in a limited space of the machine housing, the pattern cams including a first group of pattern cams rotated with a predetermined speed and a second group of pattern cams rotated with a speed different from that of the first group of pattern cams. It is another object of the invention to provide a transmission mechanism between the first group of pattern cams and a second group of pattern cams, the transmission mechanism having a predetermined transmission ratio to vary the rotation speed of the second group of pattern cams from that of the first group of pattern cams. It is still another object of the invention to provide a pattern selecting device for selecting any of the first and second groups of pattern cams by moving a cam follower along the pattern cams.

In short, the invention substantially comprises in combination a first group of pattern cams rotated in association with a drive shaft with a predetermined speed reduction; a second group of pattern cams rotated in association with the first group of pattern cams; transmission means arranged between the first and second groups of pattern cams to transmit the rotation of the first group of the pattern cams to the second group of pattern cams, the transmission means having a predetermined transmission ratio to vary the rotation speed of said second group of pattern cams from that of said first group of pattern cams: follower means including a cam follower which is swingable with respect to said first and second groups of pattern cams; means normally biasing the cam follower to engage a selected one of the first and second groups of pattern cams; and cam selecting means operated to disengage the cam follower by way of said biasing means and slidingly move the cam follower along said first and second pattern cams.

BRIEF DESCRIPTION OF THE DRAWINGS

The foregoing and further objects and advantages of the invention will be fully understood from the following detailed description when read in conjunction with the accompanying drawings, in which.

DETAILED DESCRIPTION OF THE INVENTION

Figure 1:
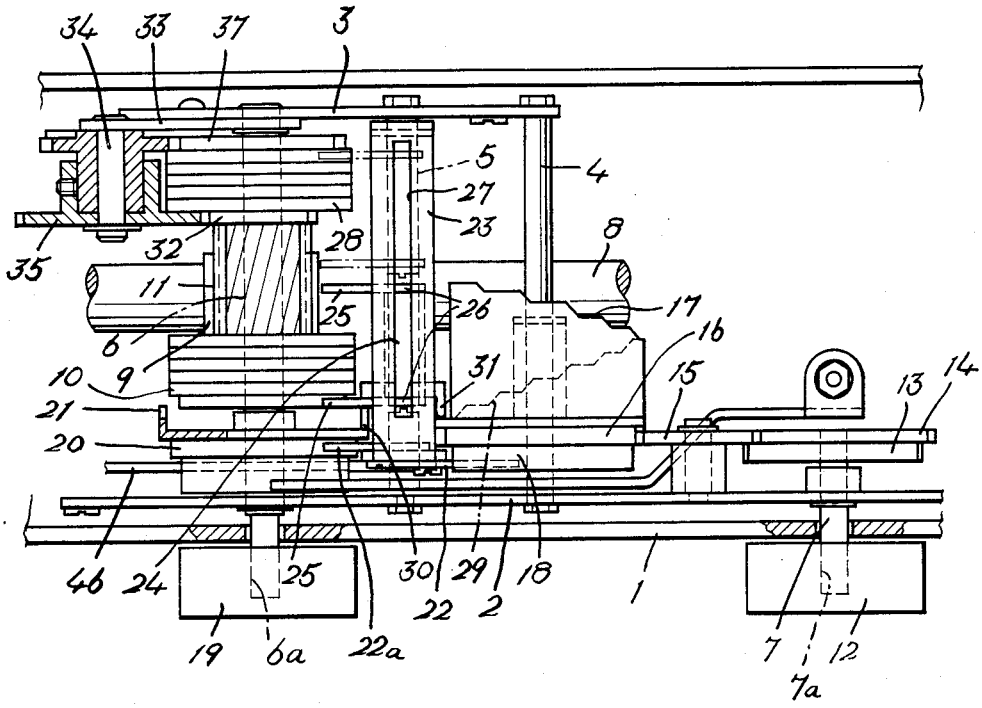
FIG. 1 is a plan view showing a first embodiment of the invention.
Figure 2:
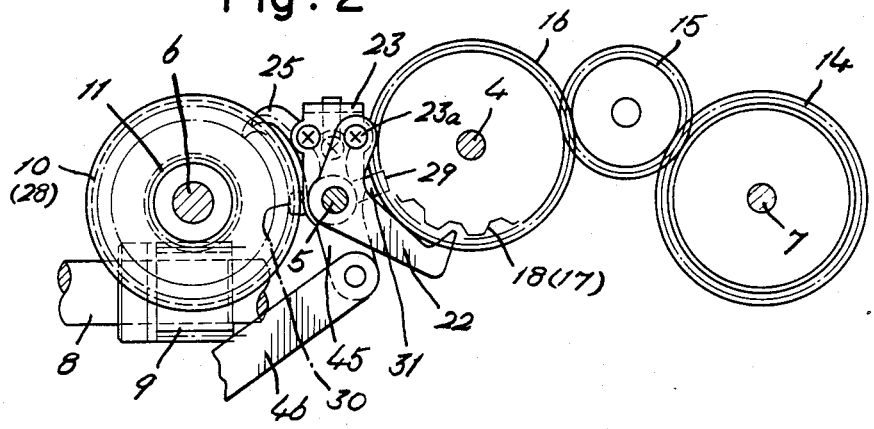
FIG. 2 is a side elevational view of FIG. 1 partly eliminated.
Figure 3:
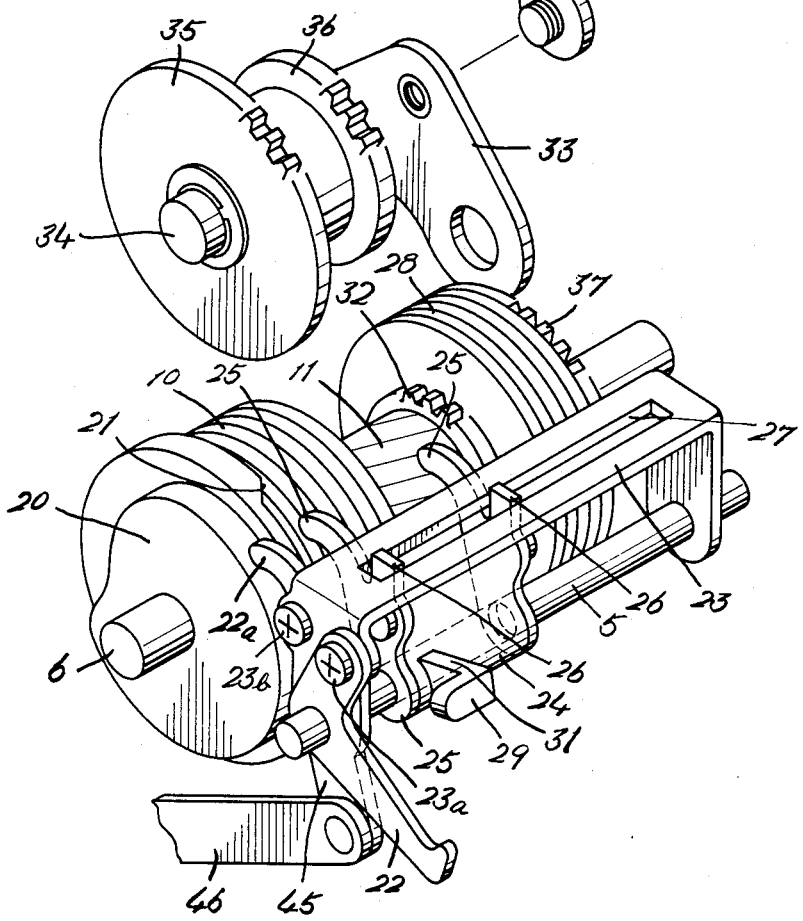
FIG. 3 is a perspective view of the invention.

In reference to FIGS. 1 to 3 showing a first embodiment of the invention, a machine housing 1 of a sewing machine has a pair of brackets 2, 3 fixedly arranged therein opposite to each other with a space provided therebetween. A pair of shafts 4, 5 are extended in parallel between the brackets 2, 3 and secured thereto. A control shaft 6 is extended between the brackets 2, 3 in parallel with the fixed shaft 5 on the left side thereof and is rotatable with respect to the brackets. The control shaft 6 has one end 6*a* projected out of the housing 1 on the front side of the sewing machine and a dial 19 secured to the end 6*a* thereof. Another control shaft 7 is rotatably arranged on the bracket 2 in parallel with the fixed shaft 4 on the right side thereof. The control shaft 7 has one end 7*a* projected out of the housing 1 on the front side of the sewing machine and a dial 12 secured to the projected end thereof.

A drive shaft 8 is rotatably arranged in the housing 1 and extending longitudinally thereof. The drive shaft 8 has a worm 9 secured thereto. The worm 9 is in engagement with a worm gear 11 which is integral with a group of integrated pattern cams 10 mounted on the control shaft 6 and rotatable relative to the latter.

As shown in FIG. 1, the control shaft 7 has an angle dividing disk 13 secured to the inner end thereof and a gear 14 secured to the angle dividing disk 13. A gear 16 is rotatably mounted on the fixed shaft 4 and an intermediate gear 15 is provided between the gear 14 and gear 16. The intermediate gear 15 is in engagement with the gears 14, 16 such that the rotation of the gear 14 is transmitted to the gear 16. The gear 16 is integral with a cylinder cam 17 for pattern selection and with a cam 18 for releasing cam followers from the pattern cams as will be described in detail herein. A cam 20 for varying the zigzag amplitude and a cam 21 for pattern selection are made integral with each other and secured to the control shaft 6.

A U-shaped frame 23 is swingably mounted on the fixed shaft 5 and is normally spring-biased in the counterclockwise direction in FIGS. 2 and 3. As shown, the U-shaped frame 23 is formed with a groove 27 extended lengthwise thereof.

A cam follower 22 is at the intermediate portion thereof turnably mounted on the fixed shaft 5. The cam follower has one end secured to the U-shaped frame 23 by means of a fastening screw 23*a* and the other end adapted to engage the cam 18 on the fixed shaft 4. A cam follower 22*a* has one end secured to the U-shaped frame 23 by means of a fastening screw 23*b* and the other end adapted to engage the cam 20 on the control shaft 6.

Figure 9:
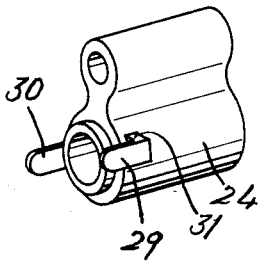
FIG. 9 is a perspective view of an element according to the invention.

As particularly shown in FIGS. 3 and 9, a slide member 24 is slidably and swingably mounted on the shaft 5 and a pair of cam followers 25, 25 are secured to one and the other ends of the slide member 24 respectively with a predetermined space being provided therebetween. Each of the cam followers 25 has an projection 26 normally engaging the guide groove 27 of the U-shaped frame 23. Further the slide member 24 is formed with a pair of projections 31 on both sides thereof. Each of the projections has a bent end 29 extended in parallel with the shaft 5. One of the projections 31 is adapted to engage the cylinder cam 17 on the shaft 4 and the other is adapted to engage the pattern selecting cam 21. The slide member 24 is normally spring-biased in the leftward direction in FIG. 3.

Another group of integrated pattern cams 28 is rotatably mounted on the control shaft 6 adjacent to a gear 32 which is integral with the worm gear 11. The integrated pattern cams 28 have a gear 37 secured to the side thereof opposite to the gear 32. A pair of spaced gears 35, 36, which are made integral with each other, are rotatably mounted on a shaft 34 supported on an arm 33 which is secured to the bracket 3. The gear 35 is in engagement with the gear 32 and the gear 36 is in engagement with the gear 37 of the pattern cams 28 such that the rotation of the worm 11 is transmitted to the pattern cams 28 through the gears 32, 35, 36, 37. The rotation speed of pattern cams 28 will be varied from that of the pattern cams 10 in dependence upon the transmission ratio of the gears 32, 35, 36, 37. One of the cam followers 25 is adapted to cooperate with the group of pattern cams 10 and the other of the cam followers 25 is adapted to the group of pattern cams 28 to thereby swing the U-shaped frame 23 around the shaft 5 in accordance with the contour of a selected pattern cam. The swinging movement of the U-shaped frame 23 is transmitted to a needle (not shown) through an extension 45 of the frame 23 and a transmission rod 46.

Figure 6:
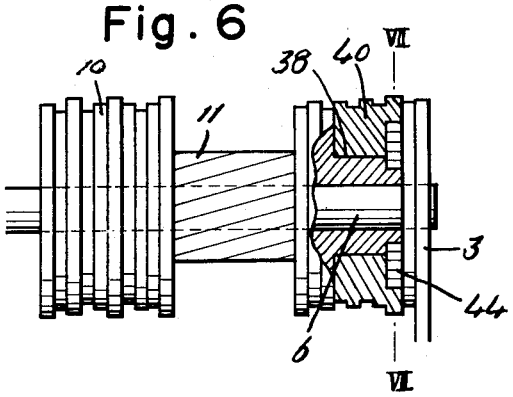
FIG. 6 is a plan view of a second embodiment showing an essential part of the invention.
Figure 7:
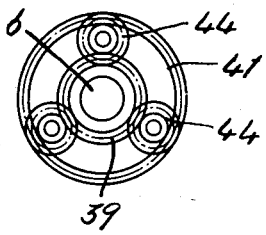
FIG. 7 is a view taken on the line VII—VII of FIG. 6.
Figure 8:
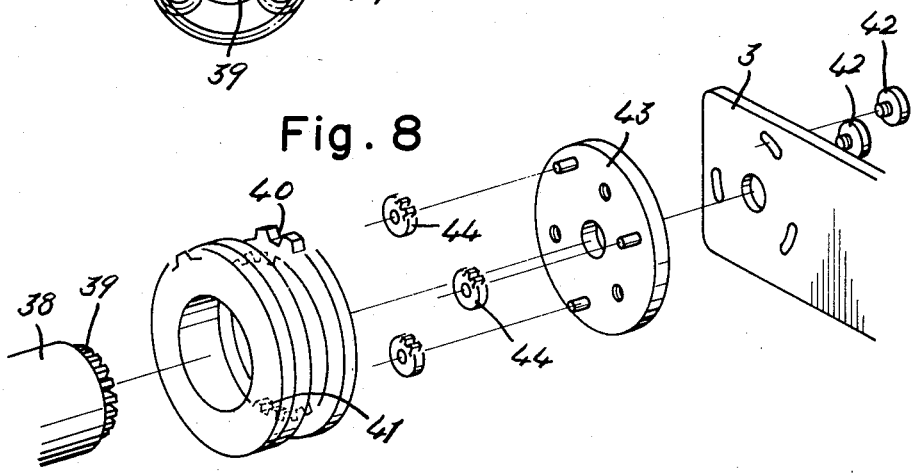
FIG. 8 is an exploded view showing a part of FIG. 6.

According to a second embodiment of the invention as shown in FIGS. 6 to 8, the group of the integrated pattern cams 10 having the worm gear 11 further has a sleeve 38 axially extended from the end of the worm gear 11. The sleeve has an end provided with a coaxial gear 39. Another group of integrated pattern cams 40 is rotatably mounted on the sleeve 38. The integrated cams 40 have an end formed with an internal gear 41. Three small gears 44 are rotatably mounted on a support disk 43 with a predetermined angular space being provided therebetween, and the support disk 43 is secured to the bracket 3 by means of fastening screws 42. The small gears 44 are arranged between the gear 39 of the sleeve 38 and the internal gear 41 of the pattern cams 40, and are in engagement with the gears 39 and 40 such that the rotation of the sleeve 38, which is rotated together with the worm 11, is transmitted to the pattern cams 40 through the series of gears 39, 44, 41. The rotation speed of the pattern cams 40 will be varied from that of the pattern cams 10 in dependence upon the transmission ratio of the series of gears 39, 44, 41.

Figure 4:
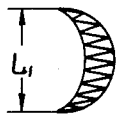
FIG. 4 is a standard pattern stitched by the invention.
Figure 5:
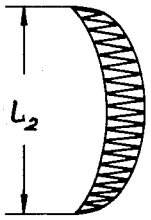
FIG. 5 is an elongated pattern of FIG. 4 stitched by the invention.

With the structure of the invention as mentioned above, the operation is as follows:

When the drive shaft 8 is rotated, the group of pattern cams 10 is rotated on the shaft 6 through the worm 9 and the worm gear 11, and simultaneously the group of pattern cams 28 is rotated through the series of gears 32, 35, 36, 37 with a reduced speed determined by the transmission ratio of the series of gears 32, 35, 36, 37. For example, if the rotation speed of the pattern cams 10 is reduced to $\frac{1}{8}$ of the rotation speed of the drive shaft 8 and the rotation speed of the pattern cams 28 is reduced to 1/36 of the rotation speed of the drive shaft 8, a pattern such as a crescent pattern actually obtained may be of a smaller size with a length $L_1$ by way of example as shown in FIG. 4 in case the corresponding pattern cam is selected from the group of pattern cams 10. On the other hand, the same crescent pattern actually obtained may be elongated twice to the size with a length $L_2$ by way of example as shown in FIG. 5 in case the corresponding pattern cam is selected from the group of pattern cams 28. The speed reduction of pattern cams 10, 28 may be optionally varied.

According to the second embodiment of the invention, when the worm gear 11 is rotated, the pattern cams 10 are rotated together with the worm gear 11, and the rotation of the worm gear 11 is transmitted to the pattern cams 40 through the series of gears 39, 44, 41. The rotation speed of the pattern cams 10 and 40 may be optionally reduced with respect to the rotation speed of the drive shaft 8 just as in the case of the first embodiment.

If the control shaft 7 is rotated by rotating the dial 12, the rotation is transmitted to the cylinder cam 17 by way of the gear 14 secured to the control shaft 7, the intermediate gear 15 and the gear 16 secured to the cylinder cam 17. When the cylinder cam 17 is rotated, which is engaged by one of the projections 31 of the slide member 24, the slide member 24 is slidingly moved along the shaft 5, and therefore one of the cam followers 25 is moved along the pattern cams 10 while the other cam follower 25 is moved in the space between the group of pattern cams 10 and another group of pattern cams 28. Thus the one of the cam followers 25 may be engaged to a selected one of the pattern cams 10. If the dial 12 is further rotated, the cylinder cam 17 moves the other of the cam followers 25 along the pattern cams 28 while the one of the cam followers 25 is moved in the space between the group of pattern cams 10 and the group of pattern cams 28. Thus the other cam follower 25 may be engaged to a selected one of the pattern cams 28. During the pattern cam selecting operation by means of the dial 12, the cam 18 is rotated together with the gear 16. The cam 18 timingly swings the follower 22 around the shaft and accordingly the U-shaped frame 23 is caused to swing around the shaft to thereby timingly disengage the cam follower 25 from the pattern cams 10 or 28. The cam follower 25 may therefore be moved along the pattern cams 10 or 28 as the dial is rotated.

If the control shaft 6 is rotated by rotating the dial 19, the cam 21 is rotated, which is engaged by the other projection 31 of the slide member 24. When the cam 21 is rotated, one of the cam followers 25 is moved between the first three of the pattern cams 10 in this embodiment. One of the three pattern cams is for straight stitching and the other two are for buttonhole stitching. The cam 20, which is rotated together with the cam 21, cooperates with the follower 22*a* to slightly swing the U-shaped frame 23 to vary the extent of engagement between the follower 25 and one of the buttonhole cams, so as to produce a series of line-tack stitches on one side of buttonhole. The U-shaped frame 23 is swingingly moved around the shaft 5 in accordance with the contours of the pattern cams 10 or 28 by way of one or the other of the cam followers 25, and the swinging movement is transmitted to the needle of the sewing machine through the extension 45 of the frame 23 and the transmission rod 46.

The embodiments of the invention are so constructed and operated as mentioned above, and therefore the structure of sewing machine is compact and the elongated patterns as well as the standard patterns may be optionally produced with easy pattern selecting operation.

What is claimed is:

1. A zigzag sewing machine having a drive shaft rotated to vertically reciprocate a swingable needle, the swinging movement of said needle being controlled by pattern cams rotated in association with the rotation of the drive shaft, said pattern cams being selectively connected to the needle by way of a transmission rod, said sewing machine comprising a first group of pattern cams rotated in association with said drive shaft with a predetermined speed reduction; a second group of pattern cams rotated in association with said first group of pattern cams; transmission means arranged between said first and secured groups of pattern cams to transmit the rotation of said first group of the pattern cams to the second group of pattern cams, said transmission means having a predetermined transmission ratio to vary the rotation speed of said second group of pattern cams from that of said first group of pattern cams: follower means including a cam follower which is swingable with respect to said first and second groups of pattern cams; means normally biasing said cam follower to engage a selected pattern cam in said first and second groups of pattern cams; and cam selecting means operated to disengage said cam follower by way of said biasing means and slidingly move said cam follower along said first and second pattern groups.

2. The zigzag sewing machine as defined in claim 1, wherein said transmission means includes a series of gears each designed to have a predetermined transmission ratio.

* * * * *